US011393452B2

(12) United States Patent
Tanaka et al.

(10) Patent No.: US 11,393,452 B2
(45) Date of Patent: Jul. 19, 2022

(54) DEVICE FOR LEARNING SPEECH CONVERSION, AND DEVICE, METHOD, AND PROGRAM FOR CONVERTING SPEECH

(71) Applicant: NIPPON TELEGRAPH AND TELEPHONE CORPORATION, Tokyo (JP)

(72) Inventors: Ko Tanaka, Tokyo (JP); Takuhiro Kaneko, Tokyo (JP); Hirokazu Kameoka, Tokyo (JP); Nobukatsu Hojo, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 16/970,925

(22) PCT Filed: Feb. 20, 2019

(86) PCT No.: PCT/JP2019/006396
§ 371 (c)(1),
(2) Date: Aug. 18, 2020

(87) PCT Pub. No.: WO2019/163848
PCT Pub. Date: Aug. 29, 2019

(65) Prior Publication Data

US 2020/0394996 A1 Dec. 17, 2020

(30) Foreign Application Priority Data

Feb. 20, 2018 (JP) ..... JP2018-028301

(51) Int. Cl.
*G10L 13/08* (2013.01)
*G10L 13/047* (2013.01)
(Continued)

(52) U.S. Cl.
CPC ..... *G10L 13/08* (2013.01); *G10L 13/047* (2013.01); *G10L 21/007* (2013.01); *G10L 2021/0135* (2013.01)

(58) Field of Classification Search
CPC ..... G10L 13/08; G10L 13/047; G10L 21/007; G10L 2021/0135
See application file for complete search history.

(56) References Cited

U.S. PATENT DOCUMENTS

2016/0379622 A1* 12/2016 Patel ..... G10L 13/033 704/260
2019/0130894 A1* 5/2019 Jin ..... G10L 13/04
2021/0225383 A1* 7/2021 Takahashi ..... G10L 21/003

OTHER PUBLICATIONS

Kaneko, T., & Kameoka, H. (2017). Parallel-data-free voice conversion using cycle-consistent adversarial networks. arXiv preprint arXiv:1711.11293.*

(Continued)

*Primary Examiner* — Bryan S Blankenagel

(57) ABSTRACT

The present invention relates to methods of converting a speech into another speech that sounds more natural. The method includes learning for a target conversion function and a target identifier according to an optimal condition in which the target conversion function and the target identifier compete with each other. The target conversion function converts source speech into target speech. The target identifier identifies whether the converted target speech follows the same distribution as actual target speech. The methods include learning for a source conversion function and a source identifier according to an optimal condition in which the source conversion function and the source identifier compete with each other. The source conversion function converts target speech into source speech, and the source identifier identifies whether the converted source speech follows the same distribution as actual source speech.

20 Claims, 11 Drawing Sheets

(51) Int. Cl.
*G10L 21/007* (2013.01)
*G10L 21/013* (2013.01)

(56) References Cited

OTHER PUBLICATIONS

Kim, S., & Choi, H. (2017). Emotional voice conversion using generative adversarial networks. GAN, 8(3.169), 5-784.*
Takamichi, Shinnosuke, et al., "A Postfilter to Modify the Modulation Spectrum in HMM-Based Speech Synthesis," 2014 IEEE International Conference on Acoustic, Speech and Signal Processing (ICASSP).
Kaneko, Takuhiro, et al., "Generative Adversarial Network-Based Postfilter for Statistical Parametric Speech Synthesis," ICASSP 978-1-5090-4117-6/17. 2017 IEEE.
Pascual, Santiago, et al., "Segan: Speech Enhancement Generative Adversarial Network," arXiv:1703.0952v3, Jun. 9, 2017.
Zhu, Jun-Yan, et al., "Unpaired Image-to-Image Translation Using Cycle-Consistent Adversarial Networks," arXiv:1703.10593v3, Nov. 24, 2017.
Choi, Yunjey, et al., "StarGAN: Unified Generative Adversarial Networks for Multi-Domain Image-to-Image Translation," arXiv:1711.09020v1, Nov. 24, 2017.

* cited by examiner

Fig. 6

| TECHNIQUE | MEAN VALUE | 95% CONFIDENCE INTERVAL |
|---|---|---|
| A | 4. 733 | ±0. 093 |
| B | 2. 322 | ±0. 180 |
| C | 3. 904 | ±0. 145 |

(A)

(B)

(C)

DEVICE FOR LEARNING SPEECH CONVERSION, AND DEVICE, METHOD, AND PROGRAM FOR CONVERTING SPEECH

CROSS-REFERENCE TO RELATED APPLICATIONS

This application is a U.S. 371 Application of International Patent Application No. PCT/JP2019/006396, filed on 20 Feb. 2019, which application claims priority to and the benefit of JP Application No. 2018-028301, filed on 20 Feb. 2018, the disclosures of which are hereby incorporated herein by reference in their entireties.

TECHNICAL FIELD

The present invention relates to a voice conversion learning system, a voice conversion system, method, and program, and more particularly, to a voice conversion learning system, a voice conversion system, method, and program for converting a voice.

BACKGROUND ART

A feature amount that represents vocal cord sound source information (such as basic frequency and non-cyclicity index) of voice and vocal tract spectrum information may be obtained using a voice analysis technique such as STRAIGHT and Mel-Generalized Cepstral Analysis (MGC). Many text voice synthesis systems and voice conversion systems take an approach of predicting series of such a voice feature amount from an input text and a converted source voice and generating a voice signal according to the vocoder method. A problem of predicting an appropriate voice feature amount from an input text and a converted source voice is a sort of regression (machine learning) problem. In particular, in a situation where only a limited number of learning samples are available, a compact (low dimension) feature amount expression is advantageous in statistical prediction. To take this advantage, many text voice synthesis systems and voice conversion systems use the vocoder method that uses a voice feature amount (instead of trying to directly predict a waveform and spectrum). Meanwhile, the vocoder method may often generate a voice that provides mechanical audio quality specific to the vocoder. This provides potential limitation on the audio quality in a conventional text voice synthesis system and voice conversion system.

To solve this problem, a method has been proposed to correct to a more natural voice feature amount in a voice feature amount space. For example, a technique (NPL 1) is proposed to correct the Modulation Spectrum (MS) of a voice feature amount processed in a text voice synthesis or a voice conversion to the MS of a natural voice. Another technique (NPL 2) is also proposed to correct the processed and converted voice feature amount to a voice feature amount of a natural voice by adding, to the processed and converted voice feature amount, a component for improving the naturalness using the Generative Adversarial Networks (GAN).

CITATION LIST

Non Patent Literature

[NPL 1] Shinnosuke Takamichi, Tomoki Toda, Graham Neubig, Sakriani Sakti, and Satoshi Naka-mura, "A post_lter to modify the modulation spectrum in hmm-based speech synthesis", in Acoustics, Speech and Signal Processing (ICASSP), 2014 IEEE International Conference on. IEEE, 2014, pp. 290-294.

[NPL 2] Takuhiro Kaneko, Hirokazu Kameoka, Nobukatsu Hojo, Yusuke Ijima, Kaoru Hiramatsu, and Kunio Kashino, "Generative adversarial network-based postfilter for statistical parametric speech synthesis", in Proc. 2017 IEEE International Conference on Acoustics, Speech and Signal Processing (ICASSP2017), 2017, pp. 4910-4914.

[NPL 3] Santiago Pascual, Antonio Bonafonte, and Joan Serra, "Segan: Speech enhancement gener-ative adversarial network", arXiv preprint arXiv:1703.09452, 2017.

[NPL 4] Jun-Yan Zhu, Taesung Park, Phillip Isola, and Alexei A Efros, "Unpaired image-to-image translation using cycle-consistent adversarial networks", arXiv preprint arXiv:1703.10593, 2017.

[NPL 5] Yunjey Choi, Minje Choi, Munyoung Kim, Jung-Woo Ha, Sunghun Kim, and Jaegul Choo, "Stargan: Unified generative adversarial networks for multi-domain image-to-image translation", arXiv preprint arXiv: 1711.09020, 2017.

SUMMARY OF THE INVENTION

Technical Problem

Although providing a certain amount of improved audio quality, the above techniques are still a correction in the compact (low dimension) space and the final voice synthesis unit passes through the vocoder, thereby still providing potential limitation on the audio quality improvement. Meanwhile, a technique (NPL 3) is proposed to directly correct the voice waveform using the GAN. This technique directly corrects the input voice waveform, so that better quality improvement is expected than the correction in the voice feature amount space. A technique using the typical GAN may be applied in limited cases and is effective in a case where there is an ideal alignment between the input waveform and the ideal target waveform. For example, when a voice recorded in an ideal environment is superimposed with noise on a computer to generate a voice under noisy environment and then the noise is removed, the audio quality may be improved because there is a perfect alignment between the voice under noisy environment as an input voice and the voice recorded in an ideal environment as a target voice. Unfortunately, in the correction from a synthetic voice generated in text voice synthesis or voice conversion to a natural voice, it is difficult to provide quality improvement by simply applying NPL 3 due to the above alignment problem.

The present invention is provided to solve the above problems and the purpose thereof is to provide a voice conversion learning system, method, and program that may learn a quality conversion function that may convert to a voice of more natural audio quality.

Another purpose of the present invention is to provide a voice conversion system, method, and program that may convert to a voice of more natural audio quality.

Means for Solving the Problem

To achieve the above purposes, a voice conversion learning system according to the present invention is configured to include a voice conversion learning system for learning a conversion function that converts a source voice to a target voice, the voice conversion learning system comprising a learning unit, the learning unit, on the basis of an input source voice and the target voice, learning about a target conversion function for converting the source voice to the target voice and a target identifier for identifying whether the converted target voice follows the same distribution as in an actual target voice, according to an optimization condition in which the target conversion function and the target identifier compete with each other, learning about a source conversion function for converting the target voice to the source voice and a source identifier for identifying whether the converted source voice follows the same distribution as in an actual source voice, according to an optimization condition in which the source conversion function and the source identifier compete with each other, and learning the source conversion function and the target conversion function so that the source voice reconfigured from the converted target voice using the source conversion function coincides with an original source voice and so that the target voice reconfigured from the converted source voice using the target conversion function coincides with an original target voice.

A voice conversion learning method according to the present invention is a voice conversion learning method in a voice conversion learning system for learning a conversion function that converts a source voice to a target voice, the method comprising, on the basis of an input source voice and the target voice, learning, by a learning unit, about a target conversion function for converting the source voice to the target voice and a target identifier for identifying whether the converted target voice follows the same distribution as in an actual target voice, according to an optimization condition in which the target conversion function and the target identifier compete with each other, learning, by the learning unit, about a source conversion function for converting the target voice to the source voice and a source identifier for identifying whether the converted source voice follows the same distribution as in an actual source voice, according to an optimization condition in which the source conversion function and the source identifier compete with each other, and learning, by the learning unit, the source conversion function and the target conversion function voice conversion learning method so that the source voice reconfigured from the converted target voice using the source conversion function coincides with an original source voice and so that the target voice reconfigured from the converted source voice using the target conversion function coincides with an original target voice.

A voice conversion system according to according to the present invention is a voice conversion system for converting a source voice to a target voice, the voice conversion system comprising a voice conversion unit for, using a previously learned target conversion function for converting the source voice to the target voice, converting an input source voice to a target voice, the target conversion function being, on the basis of an input source voice and a target voice, learned about the target conversion function and a target identifier for identifying whether the converted target voice follows the same distribution as in an actual target voice, according to an optimization condition in which the target conversion function and the target identifier compete with each other, learned about a source conversion function for converting the target voice to the source voice and a source identifier for identifying whether the converted source voice follows the same distribution as in an actual source voice, according to an optimization condition in which the source conversion function and the source identifier compete with each other, and previously learned so that the source voice reconfigured from the converted target voice using the source conversion function coincides with an original source voice and so that the target voice reconfigured from the converted source voice using the target conversion function coincides with an original target voice.

A voice conversion method according to the present invention is a voice conversion method in a voice conversion system for converting a source voice to a target voice, the method comprising using a previously learned target conversion function for converting the source voice to the target voice to convert an input source voice to a target voice, by a voice conversion unit, the target conversion function being, on the basis of an input source voice and the target voice, learned about the target conversion function and a target identifier for identifying whether the converted target voice follows the same distribution as in an actual target voice, according to an optimization condition in which the target conversion function and the target identifier compete with each other, learned about a source conversion function for converting the target voice to the source voice and a source identifier for identifying whether the converted source voice follows the same distribution as in an actual source voice, according to an optimization condition in which the source conversion function and the source identifier compete with each other, and previously learned so that the source voice reconfigured from the converted target voice using the source conversion function coincides with an original source voice and so that the target voice reconfigured from the converted source voice using the target conversion function coincides with an original target voice.

A program according to the present invention is a program for allowing a computer to function as each part included in the above voice conversion learning system or the above voice conversion system.

Effects of the Invention

A voice conversion learning system, a method, and a program according to the present invention may provide an effect of being able to convert to a voice of more natural audio quality by learning about a target conversion function for converting the source voice to the target voice and a target identifier for identifying whether the converted target voice follows the same distribution as in an actual target voice, according to an optimization condition in which the target conversion function and the target identifier compete with each other, learning about a source conversion function for converting the target voice to the source voice and a source identifier for identifying whether the converted source voice follows the same distribution as in an actual source voice, according to an optimization condition in which the source conversion function and the source identifier compete with each other, and learning so that the source voice reconfigured from the converted target voice using the source conversion function coincides with an original source voice and so that the target voice reconfigured from the converted source voice using the target conversion function coincides with an original target voice.

In addition, a voice conversion system, a method, and a program according to the present invention may provide an effect of being able to convert to a voice of more natural audio quality by using a target conversion function learned about the target conversion function and a target identifier for identifying whether the converted target voice follows the same distribution as in an actual target voice, according to an optimization condition in which the target conversion function and the target identifier compete with each other, learned about a source conversion function for converting the target voice to the source voice and a source identifier for identifying whether the converted source voice follows the same distribution as in an actual source voice, according to an optimization condition in which the source conversion function and the source identifier compete with each other, and previously learned so that the source voice reconfigured from the converted target voice using the source conversion function coincides with an original source voice and so that the target voice reconfigured from the converted source voice using the target conversion function coincides with an original target voice.

BRIEF DESCRIPTION OF DRAWINGS

FIG. 6 shows experimental results.

DESCRIPTION OF EMBODIMENTS

Embodiments of the present invention will be described in more detail below with reference to the drawings.

<Overview according to Embodiments of Present Invention>

An overview according to embodiments of the present invention will be first described.

The embodiments of the present invention may solve the alignment problem by an approach based on the cycle-consistent adversarial networks (NPL 4, 5) and provide waveform correction from the synthetic voice to the natural voice. The primary purpose of the technology in the embodiments of the present invention is to provide waveform conversion to a voice of more natural audio quality from a sound synthesized by the vocoder method using a voice feature amount processed by a text voice synthesis or voice conversion. It is commonly known that the voice synthesis technology of the vocoder method may provide great benefit. It is still very important that the embodiments of the present invention may provide additional processing to the voice synthesis technology of the vocoder method.

As described above, the embodiments of the present invention relate to a technique to convert from a voice signal to a voice signal by an approach based on the cycle-consistent adversarial networks (NPL 4, 5), which draw attention in the image generation field.

A description will now be given of related technologies 1 to 3 in the embodiments of the present invention.

<Related Technology 1>

Figure 8:
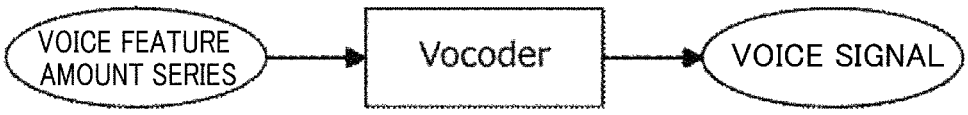
FIG. 8 shows a framework of voice synthesis by the vocoder method.

The voice synthesis of the existing vocoder method generates a voice by converting, using a vocoder, voice feature amount series, such as vocal cord sound source information and vocal tract spectrum information. FIG. 8 shows a flow of the voice synthesis process of the vocoder method. Note that the vocoder as described here is a modeling of the sound generation process based on the knowledge about the mechanism of human vocalization. For example, a source filter model is known as a representative model of the vocoder. This model describes the sound generation process using two things of a sound source (source) and a digital filter. Specifically, a voice is generated by applying the digital filter, as needed, to a voice signal (expressed as a pulse signal) generated from the source table. As described above, the voice synthesis of the vocoder method expresses the vocalization mechanism by abstract modeling, so that it may provide compact (low dimension) expression of the voice. Meanwhile, the abstraction often loses the naturalness of the voice, providing mechanical audio quality specific to the vocoder.

<Related Technology 2>

Figure 9:
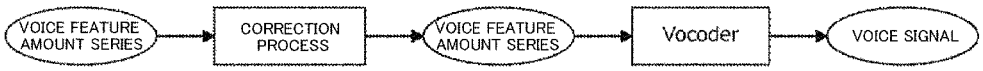
FIG. 9 shows a framework of correction process for voice feature amount series.

In the framework of the existing voice feature amount correction (FIG. 9), the voice feature amount is corrected before it passes through the vocoder. For example, a logarithmic amplitude spectrum for the voice feature amount series is corrected so that it matches the logarithmic amplitude spectrum of the voice feature amount of the natural voice series. These technologies are particularly effective when the voice feature amount is processed. For example, while the text voice synthesis and voice conversion have a tendency that the processed voice feature amount is excessively smoothed, losing the fine structure, the above technologies may address this problem and provide a certain amount of quality improvement. Unfortunately, the technologies are still correction in the compact (low dimension) space and the final voice synthesis unit passes through the vocoder, thereby still providing potential limitation on the audio quality improvement.

<Related Technology 3>

Figure 10:
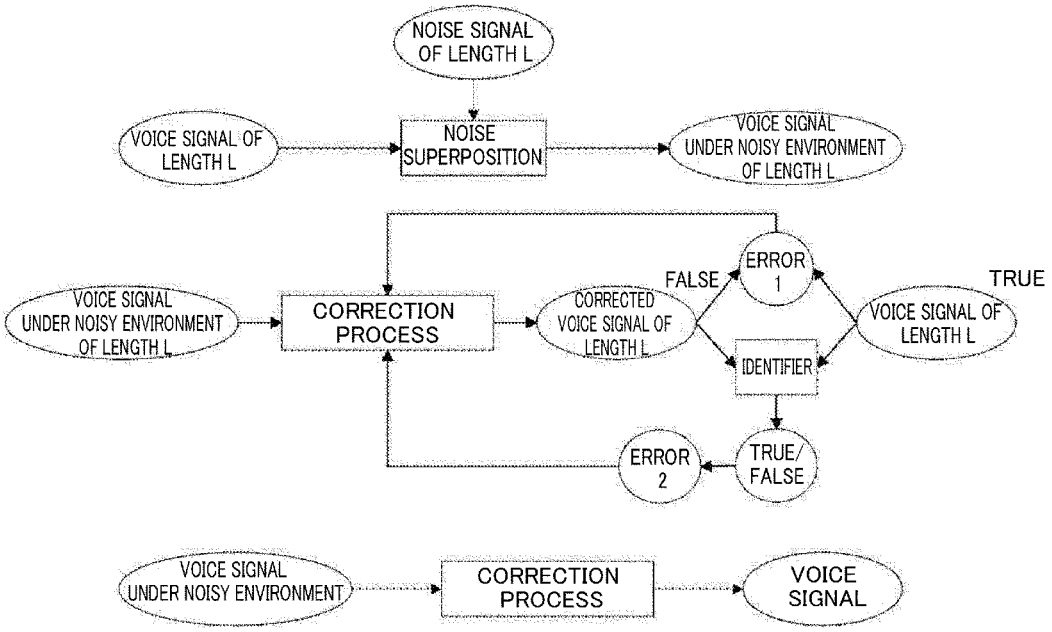
FIG. 10 shows an example of correction process for a voice waveform using GAN.

In the framework of the existing voice waveform correction (FIG. 10), the waveform is directly corrected. For example, a voice recorded under an ideal environment is superimposed with noise on a computer to generate a voice under noisy environment and then mapping from the voice waveform under noisy environment to the voice waveform recorded under the ideal environment mapping is learned and the conversion is performed. Related technology 3 does not provide the potential limitation on the audio quality improvement unlike related technology 2, because the final voice synthesis unit does not pass through the vocoder after the correction unlike the related technology 2. Unfortunately, related technology 3 is particularly effective when there is an ideal alignment in the time domain between the input waveform and the ideal target waveform (for perfectly parallel data), and it is difficult to simply apply related technology 3 for non-perfectly parallel data. For example, it is difficult to simply apply the correction from the synthetic voice generated in the text voice synthesis or voice conversion to the natural voice (FIG. 11) due to the problem of the alignment between the two voices.

<Principle of Proposed Technique>

Figure 1:
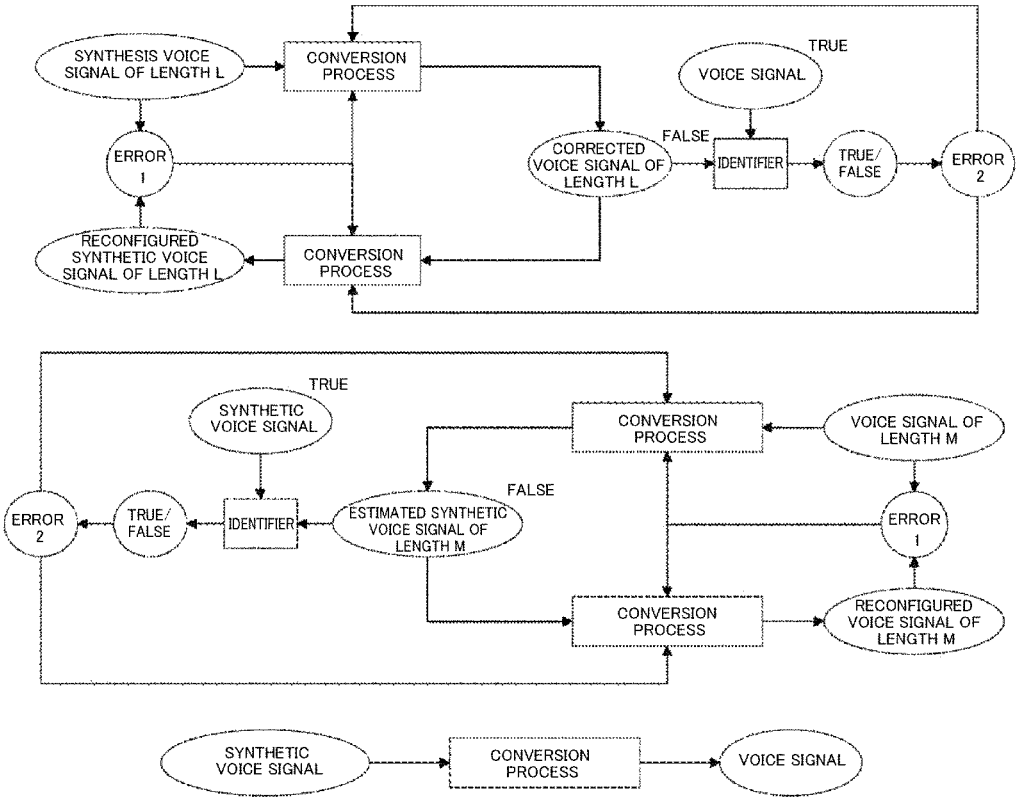
FIG. 1 is a schematic diagram of processing according to an embodiment of the present invention.

The technology according to the embodiments of the present invention includes a learning process and a correction process (see FIG. 1).

<Learning Process>

It is assumed that a learning process includes a source voice (for example, a voice synthesized by the text voice synthesis) and a target voice (for example, a normal voice). Note that the voice data may not be parallel data.

First, the source voice x is converted to the target voice, and the converted voice (subsequently, a converted source voice $G_{x\to y}(x)$) is converted again to the source voice (subsequently, a reconfigured source voice $G_{y\to x}(G_{x\to y}(x))$). Meanwhile, the target voice y is converted to the source voice converted, and the converted voice (subsequently, a converted target voice $G_{y\to x}(y)$) is converted again to the target voice (subsequently, a reconfigured target voice $G_{x\to y}(G_{y\to x}(y))$). Here, in learning a model (conversion function G) described in a neural net, an identifier D is provided for identifying the converted source and target voices and the actual source and target voices and the model is learned to dupe the identifier, as in the normal GAN. Note that a restriction $L_{cyc}$ is added so that the reconfigured source and target voices coincide with the original source and target voices. A purpose function L in learning is as follows,

[Formula 1]

$$L=L_{adv}(G_{x\to y},D_y)+L_{adv}(G_{y\to x},D_x)+\lambda L_{cyc}, \quad (1)$$

$$L_{adv}(G_{x\to y},D_y)=E_{y\sim P_{Data(y)}}[\log D_y(y)]+E_{x\sim P_{Data(x)}}[\log(1-D_y(G_{x\to y}(x))], \quad (2)$$

$$L_{adv}(G_{y\to x},D_x)=E_{x\sim P_{Data(x)}}[\log D_x(x)]+E_{y\sim P_{Data(y)}}[\log(1-D_x(G_{y\to x}(y))], \quad (3)$$

$$L_{cyc}=E_{x\sim P_{Data(x)}}[\|G_{y\to x}(G_{x\to y}(x))-x\|_1]+E_{y\sim P_{Data(y)}}[\|G_{x\to y}(G_{y\to x}(y))-y\|_1], \quad (4)$$

Where, λ is a weight parameter for controlling a restriction term that causes the reconfigured source and target voices to coincide with the original source and target voices. Note that G may learn two models separately because of $G_{x\to y}$ and $G_{y\to x}$ and may also be expressed in one model as a conditional GAN. Likewise, D may also be expressed as two independent models of $D_x$ and $D_y$ and may also be expressed in one model as a conditional GAN.

<Correction Process>

Once the neural network is learned, any voice waveform series may be input in a learned neural network to obtain the target voice data.

<Configuration of Voice Conversion Learning System According to Embodiment of Present Invention>

Figure 2:
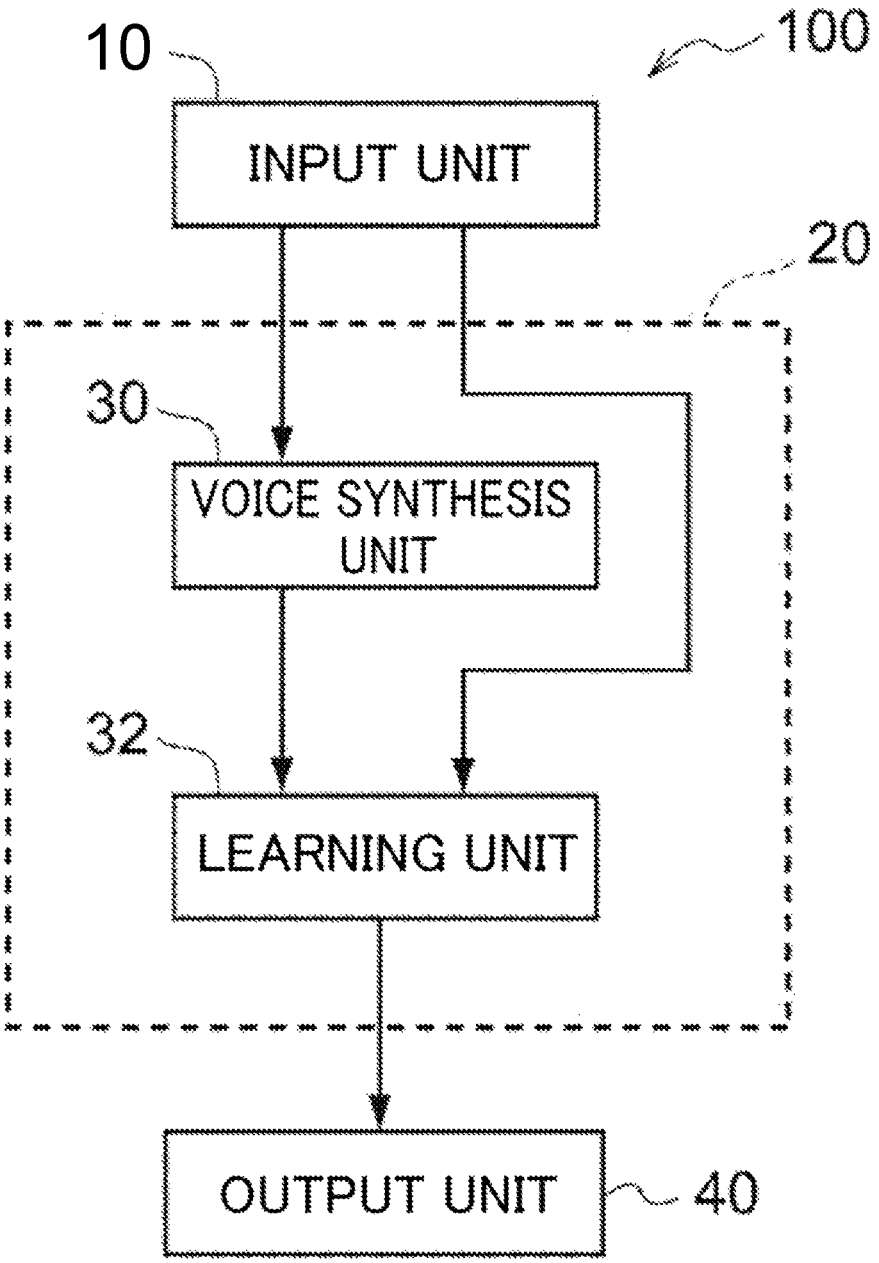
FIG. 2 is a block diagram of a configuration of a voice conversion learning system according to an embodiment of the present invention.

A description will now be given of a configuration of a voice conversion learning system according to an embodiment of the present invention. As shown in FIG. 2, a voice conversion learning system 100 according to an embodiment of the present invention may be configured by a computer including a CPU, a RAM, and a ROM that stores a program and various data for performing a learning process routine described below. The voice conversion learning system 100 includes, from a functional point of view, an input unit 10, an operation unit 20, and an output unit 40, as shown in FIG. 2.

The input unit 10 receives, as learning data, a text from which the source voice is generated and, as the target voice, normal human voice data, as an input.

Note that instead of a text, the input unit 10 may receive, as an input, any voice feature amount series from which the synthetic voice is generated.

The operation unit 20 is configured by including a voice synthesis unit 30 and a learning unit 32.

Figure 11:
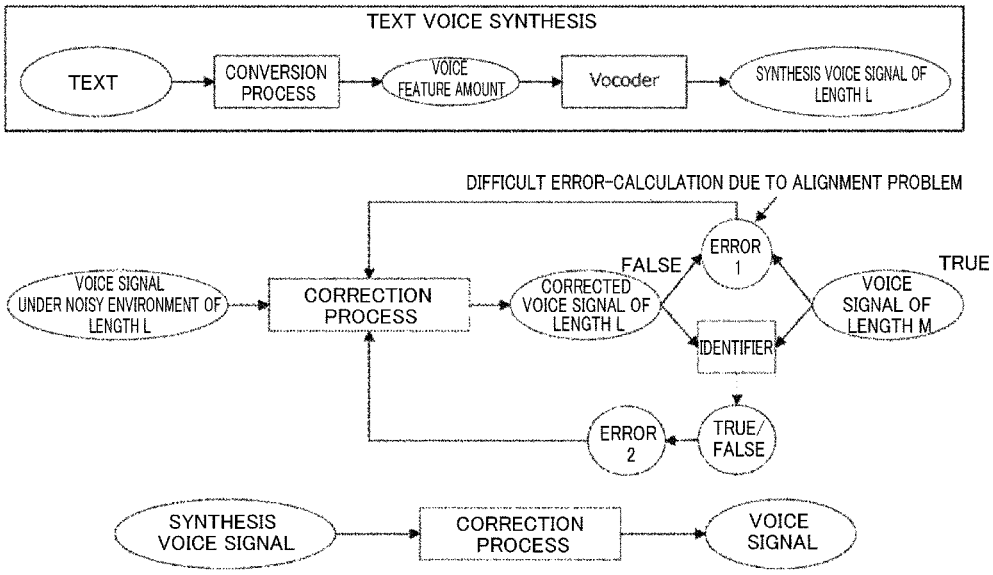
FIG. 11 shows an example where simple application of the related technology 3 is difficult.

The voice synthesis unit 30 generates a synthetic voice from the input text as a source voice, by the text voice synthesis using a vocoder for synthesizing a voice from a voice feature amount, as shown in the upper part of FIG. 11.

The learning unit 32 conducts the following three learnings. First, learning, on the basis of a source voice generated by the voice synthesis unit 30 and an input target voice, about a target conversion function for converting a source voice to a target voice and a target identifier for identifying whether the converted target voice follows the same distribution as in the actual target voice, according to an optimization condition in which the target conversion function and the target identifier compete with each other. Second, learning about a source conversion function for converting a target voice to a source voice and a source identifier for identifying whether the converted source voice follows the same distribution as in the actual source voice, according to an optimization condition in which the source conversion function and the source identifier compete with each other. Third, learning the source conversion function and the target conversion function so that the source voice reconfigured from the converted target voice using the source conversion function coincides with an original source voice and so that the target voice reconfigured from the converted source voice using the target conversion function coincides with an original target voice.

Specifically, the learning unit 32 learns each of the target conversion function, the target identifier, the source conversion function, and the source identifier, in order to maximize the purpose function shown in the above equations (1) to (4).

In so doing, the learning unit 32 learns each of the target conversion function, the target identifier, the source conversion function, and the source identifier by alternately repeating the two learnings shown below, in order to maximize the purpose function shown in the above equations (1) to (4). The first learning to learn each of the target conversion function, the source conversion function, and the target identifier, in order to minimize the errors 1 and 2 shown in the upper part of the above-described FIG. 1. The second learning is to learn each of the target conversion function, the source conversion function, and the source identifier, in order to minimize the errors 1 and 2 shown in the middle part of the above-described FIG. 1.

Each of the target conversion function, the target identifier, the source conversion function, the source identifier, the source conversion function, and target conversion function is configured by using a neural network.

<Configuration of Voice Conversion System According to Embodiment of Present Invention>

Figure 3:
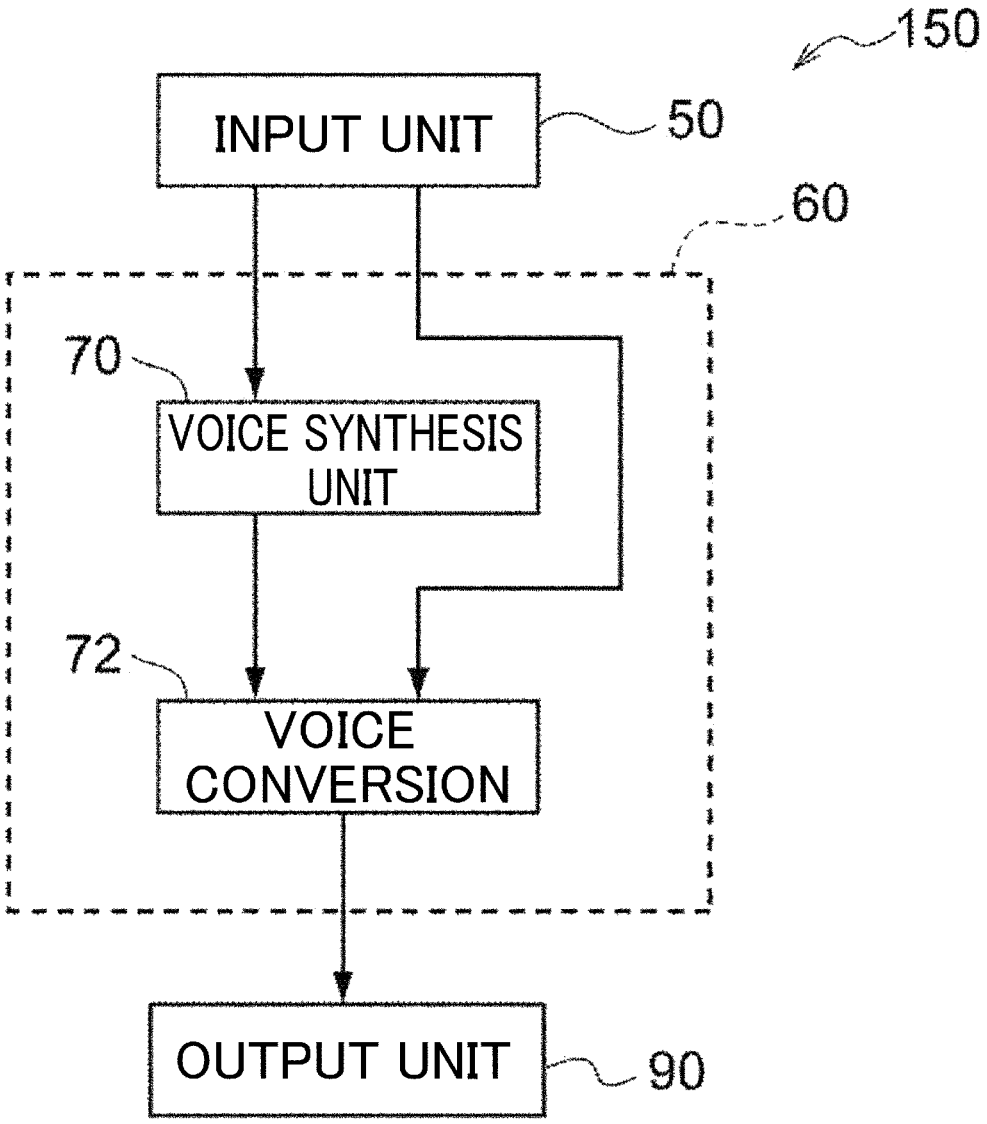
FIG. 3 is a block diagram of a configuration of a voice conversion system according to an embodiment of the present invention.

A description will now be given of a configuration of a voice conversion system according to an embodiment of the present invention. As shown in FIG. 3, a voice conversion system 150 according to an embodiment of the present invention may be configured by a computer including a CPU, a RAM, and a ROM that stores a program and various data for performing a learning process routine described below. The voice conversion system 150 includes, from a functional point of view, an input unit 50, an operation unit 60, and an output unit 90, as shown in FIG. 3.

The input unit 50 receives a text from which the source voice is generated. Note that instead of a text, the input unit 50 may receive, as an input, any voice feature amount from which the synthetic voice is generated from.

The operation unit 60 is configured by including a voice synthesis unit 70 and a voice conversion unit 72.

The voice synthesis unit 70 generates a synthetic voice from the input text as a source voice, by the text voice synthesis using a vocoder for synthesizing a voice from a voice feature amount, as shown in the upper part of FIG. 11.

A target conversion function is provided for converting the source voice to the target voice and is previously learned by the voice conversion learning system 100. The voice conversion unit 72 uses the target conversion function to convert the source voice generated by the voice synthesis unit 70 to the target voice. The target voice is output by the output unit 90.

<Operation of Voice Conversion Learning System According to Embodiment of Present Invention>

Figure 4:
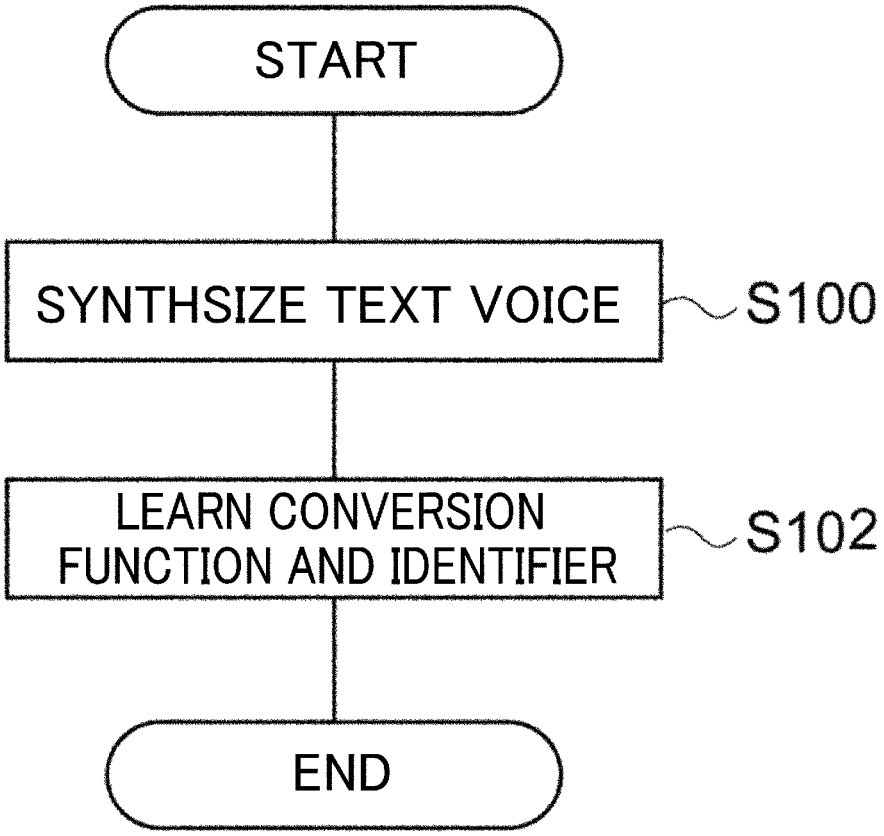
FIG. 4 is a flowchart of a learning process routine of a voice conversion learning system according to an embodiment of the present invention.

A description will now be given of an operation of the voice conversion learning system 100 according to an embodiment of the present invention. As the input unit 10 receives, as learning data, a text from which the source voice is generated, and as the target voice, normal human voice data, as an input, the voice conversion learning system 100 performs the learning process routine as shown in FIG. 4.

First, at step S100, the text voice synthesis using a vocoder generates a synthetic voice as a source voice from the text received by the input unit 10.

Next, at step S102, the following three learnings are conducted. First, learning, on the basis of the source voice obtained at step S100 and the target voice received by the input unit 10, about a target conversion function for converting a source voice to a target voice and a target identifier for identifying whether the converted target voice follows the same distribution as in an actual target voice, according to an optimization condition in which the target conversion function and the target identifier compete with each other. Second, learning about a source conversion function for converting a target voice to a source voice and a source identifier for identifying whether the converted source voice follows the same distribution as in the actual source voice, according to an optimization condition in which the source conversion function and the source identifier compete with each other learning. Third, learning the source conversion function and the target conversion function so that the source voice reconfigured from the converted target voice using a source conversion function coincides with the original source voice and so that the target voice reconfigured from the converted source voice using a target conversion function coincides with the original target voice with. Additionally, at step 102, the output unit 40 outputs the learning result. The learning process routine is then ended.

<Operation of Voice Conversion System According to Embodiment of Present Invention>

Figure 5:
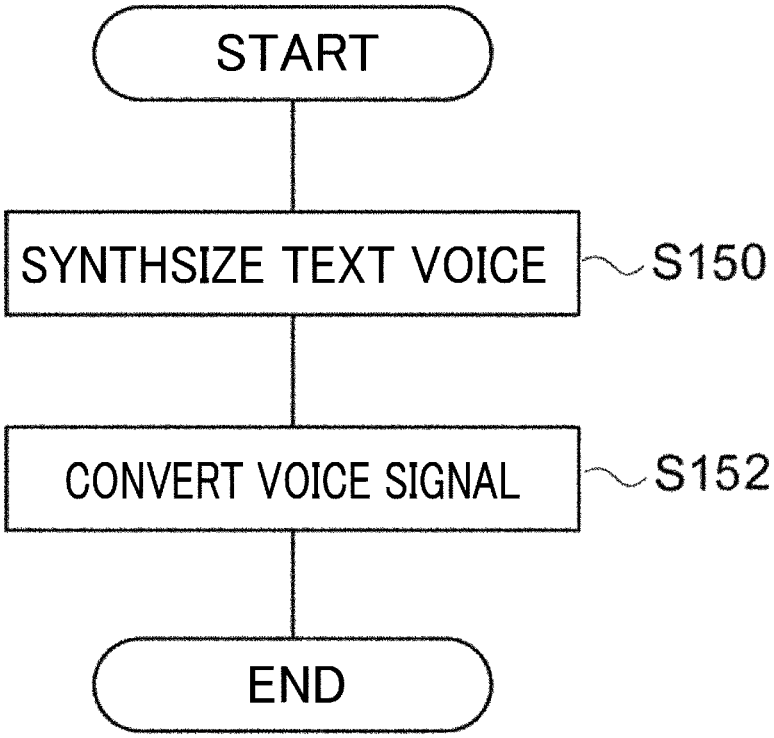
FIG. 5 is a flowchart of a voice conversion process routine of a voice conversion system according to an embodiment of the present invention.

The input unit 50 receives a learning result by the voice conversion learning system 100. In addition, as the input unit 50 receives a text from which the source voice is generated, the voice conversion system 150 performs the voice conversion process routine as shown in FIG. 5.

At step S150, a synthetic voice is generated as the source voice from the text received by the input unit 50, by the text voice synthesis using a vocoder for synthesizing a voice from a voice feature amount, as shown in the upper part of FIG. 11.

A target conversion function is provided for converting the source voice to the target voice and is previously learned by the voice conversion learning system 100. At step S152, the target conversion function is used to convert the source voice generated at the above step S150 to the target voice. The target voice is output by the output unit 90. The voice conversion process routine is then ended.

<Experimental Results>

An experiment is performed using one implementing method to demonstrate the validity of the embodiments of the present invention. A synthetic voice synthesized by the vocoder method from the voice feature amount estimated by the text voice synthesis is corrected to a more natural voice. A voice hearing experiment based on the five-point opinion score was performed to 10 subjects using 30 sentences not included in the learning data. The voice to be evaluated includes three types of voices: A) the target voice; B) a voice synthesized by the text voice synthesis; and C) the voice of B) applied with the proposed technique. The evaluation axis is "whether vocalized by a person or not". 5 is defined as a "human voice" and 1 is defined as a "synthetic voice".

Figure 7:
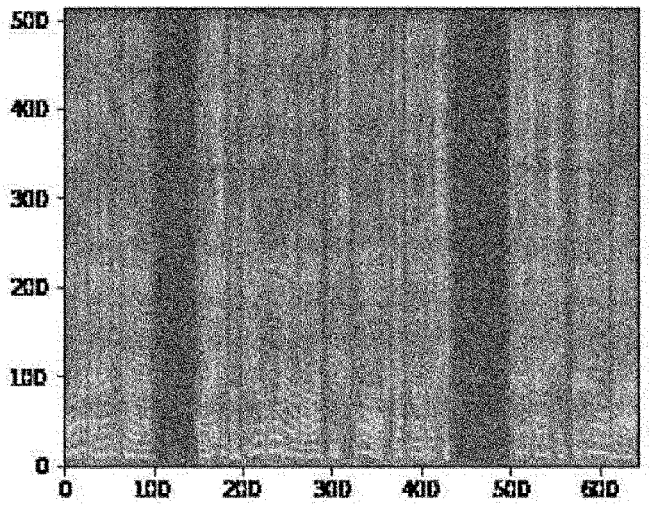
FIG. 7(A) shows a waveform of a target voice.
FIG. 7(B) shows a waveform of a voice synthesized by text voice synthesis.
FIG. 7(C) shows a result of applying processing according to an embodiment of the present invention to a voice synthesized by text voice synthesis.
Figure 7:
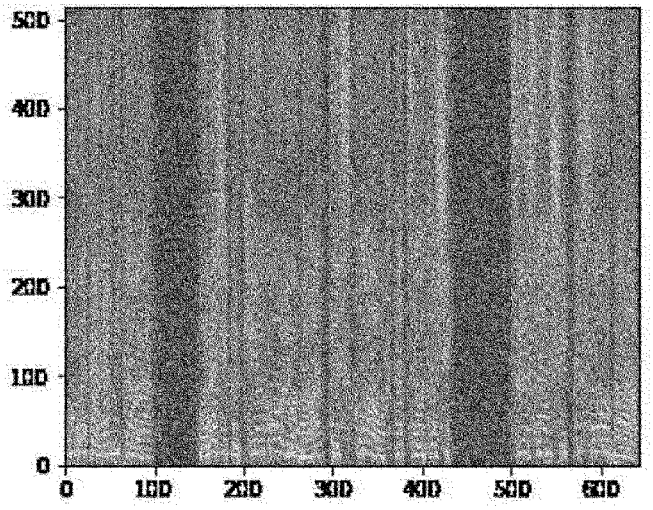
Figure 7:
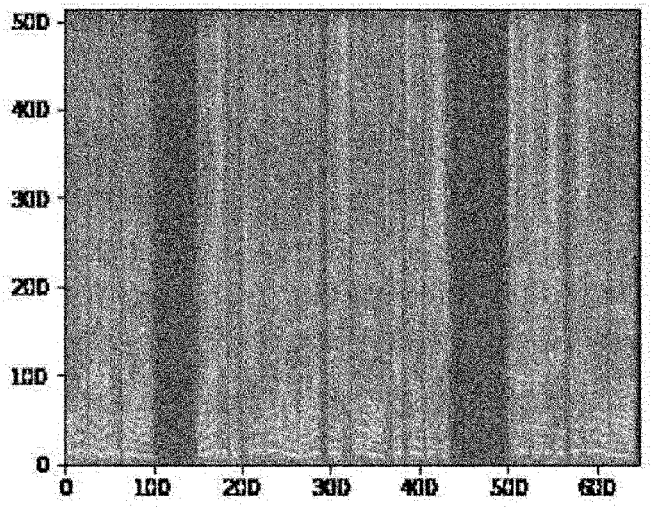

The results are shown in FIG. 6, which demonstrate a great improvement. FIG. 7 shows spectrogram of each voice sample in the experiment.

As described above, the voice conversion learning system according to an embodiment of the present invention conducts the following three learnings. First, learning about a target conversion function for converting a source voice to a target voice and a target identifier for identifying whether the converted target voice follows the same distribution as in an actual target voice, according to an optimization condition in which the target conversion function and the target identifier compete with each other. Second, learning about a source conversion function for converting a target voice to a source voice and a source identifier for identifying whether the converted source voice follows the same distribution as in the actual source voice, according to an optimization condition in which the source conversion function and the source identifier compete with each other. Third, learning so that the source voice reconfigured from the converted target voice using a source conversion function coincides with the original source voice and so that the target voice reconfigured from the converted source voice using a target conversion function coincides with the original target voice. In this way, the voice conversion learning system may convert to a voice of more natural audio quality.

In addition, the voice conversion system according to an embodiment of the present invention is learned about the target conversion function and the target identifier, according to an optimization condition in which the target conversion function and the target identifier compete with each other. And, the voice conversion system is learned about the source conversion function and the source identifier, according to an optimization condition in which the source conversion function and the source identifier compete with each other. And, the voice conversion system uses a target conversion function that is previously learned so that the source voice reconfigured from the converted target voice using a source conversion function coincides with the original source voice and so that the target voice reconfigured from the converted source voice using a target conversion function coincides with the original target voice, making it possible to convert to a voice of more natural audio quality.

Note that the present invention is not limited to the above described embodiments and various modifications and application may be made without departing from the spirit of the present invention.

For example, although in the above described embodiments, the voice conversion learning system and voice conversion system are configured to be distinct systems, they may be configured to be as one system.

In addition, while the above-described voice conversion learning system and voice conversion system include a computer system therein, the "computer system" is defined to include a website providing environment (or a display environment) as long as it uses the WWW system.

In addition, although the specification of the present application describes embodiments in which a program is previously installed, the relevant program may be provided after being stored in a computer-readable storage medium.

REFERENCE SIGNS LIST

10 Input unit
20 Operation unit
30 Voice synthesis unit
32 Learning unit
40 Output unit
50 Input unit
60 Operation unit
70 Voice synthesis unit
72 Voice conversion unit
90 Output unit
100 Voice conversion learning system
150 Voice conversion system

The invention claimed is:

1. A computer-implemented method for learning speech conversion, the method comprising:

receiving an original source voice and an original target voice as input data;

generating a combination of a target conversion model and a target identifier based on first training, wherein the target conversion model converts the original source voice into a first converted target voice, wherein the target identifier identifies whether the first converted target voice follows the same distribution as in the original target voice, and wherein the first training of the combination of the target conversion model and the target identifier uses an optimization condition in which the target conversion model and the target identifier compete with each other;

generating a combination of a source conversion model and a source identifier based on second training, wherein the source conversion model converts the first converted target voice to a first converted source voice, wherein the source identifier identifies whether the converted source voice follows the same distribution as in the original source voice, and wherein the second training of the combination of the source conversion model and the source identifier uses an optimization condition in which the source conversion model and the source identifier compete with each other;

updating, as third training, the target conversion model trained based on the first training and the source conversion model trained based on the second training, wherein the target conversion model trained based on the first training converts the first converted source voice into a second converted target voice, wherein the trained source conversion model trained based on the second training converts the first converted target voice into a second converted source voice, and wherein the third training is based on conditions including:

the second converted source voice coincides with the original source voice, and the second converted target voice coincides with the original target voice; and providing the second converted target voice.

2. The computer-implemented method of claim 1, wherein the source voice is a synthetic voice generated using a vocoder at least from a voice feature amount, and wherein the first converted target voice is an actual voice data.

3. The computer-implemented method of claim 1, wherein one or more of the target conversion model, the target identifier, the source conversion model, and the source identifier is configured using a neural network.

4. The computer-implemented method of claim 1, wherein the original source voice is at least one of:

text data, or a series of voice feature amount data over time.

5. The computer-implemented method of claim 1, the method further comprising:

receiving waveform voice data as another source voice;

generating another target voice based on the updated target conversion model based on training; and providing the another target voice as a synthesized voice data.

6. The computer-implemented method of claim 1, wherein the source conversion model and the target conversion model are based on one model associated with a conditional generative adversarial network (GAN).

7. The computer-implemented method of claim 1, wherein the original source voice and the first converted target voice are non-parallel data.

8. A system for machine learning, the system comprises:

a processor; and a memory storing computer-executable instructions that when executed by the processor cause the system to:

receive an original source voice and an original target voice as input data;

generate a combination of a target conversion model and a target identifier based on first training, the target conversion model converts the original source voice into a first converted target voice, wherein the target identifier identifies whether the first converted target voice follows the same distribution as in the original target voice, and wherein the first training of the combination of the target conversion model and the target identifier uses an optimization condition in which the target conversion model and the target identifier compete with each other;

generate a combination of a source conversion model and a source identifier based on second training, wherein the source conversion model converts the first converted target voice to a first converted source voice, wherein the source identifier identifies whether the converted source voice follows the same distribution as in the original source voice, and wherein the second training of the combination of the source conversion model and the source identifier uses an optimization condition in which the source conversion model and the source identifier compete with each other;

update, as third training, the target conversion model trained based on the first training and the source conversion model trained based on the second training, wherein the target conversion model trained based on the first training converts the first converted source voice into a second converted target voice, wherein the trained source conversion model trained on the second training converts the first converted target voice into a second converted source voice, and wherein the third training is based on conditions including:

the second converted source voice coincides with the original source voice, and the second converted target voice coincides with the original target voice; and provide the second converted target voice.

9. The system of claim 8, wherein the source voice is a synthetic voice generated using a vocoder at least from a voice feature amount, and wherein the first converted target voice is an actual voice data.

10. The system of claim 8, wherein one or more of the target conversion model, the target identifier, the source conversion model, and the source identifier is configured using a neural network.

11. The system of claim 8, wherein the source voice is at least one of:

text data, or a series of voice feature amount data over time.

12. The system of claim 8, the computer-executable instructions when executed further causing the system to:

receive waveform voice data as another source voice;

generate another target voice based on the updated target conversion model based on training; and provide the another target voice as a synthesized voice data.

13. The system of claim 8, wherein the source conversion model and the target conversion model are based on one model based on a conditional generative adversarial network (GAN).

14. The system of claim 8, wherein the original source voice and the converted target voice are non-parallel data.

15. A computer-readable non-transitory recording medium storing computer-executable instructions that when executed by a processor cause a computer system to:

receive an original source voice and an original target voice as input;

generate a combination of a target conversion model and a target identifier based on first training, the target conversion model converts the original source voice into a first converted target voice, wherein the target identifier identifies whether the first converted target voice follows the same distribution as in the original target voice, and wherein the first training of the combination of the target conversion model and the target identifier uses an optimization condition in which the target conversion model and the target identifier compete with each other;

generate a combination of a source conversion model and a source identifier based on second training, wherein the source conversion model converts the first converted target voice to a first converted source voice, wherein the source identifier identifiers whether the converted source voice follows the same distribution as in the original source voice, and wherein the second training of the combination of the source conversion model and the source identifier uses an optimization condition in which the source conversion model and the source identifier compete with each other;

update, as third training, the target conversion model trained based on the first training and the source conversion model trained based on the second training, wherein the target conversion model trained based on the first training converts the first converted source voice into a second converted target voice, wherein the trained source conversion model trained based on the second training converts the first converted target voice into a second converted source voice, and wherein the third training is based on condition including:

the second converted source voice coincides with the original source voice, and the second converted target voice coincides with the original target voice; and provide the second converted target voice.

16. The computer-readable non-transitory recording medium of claim 15, wherein the source voice is a synthetic voice generated using a vocoder at least from a voice feature amount, and wherein the first converted target voice is an actual voice data.

17. The computer-readable non-transitory recording medium of claim 15, wherein one or more of the target conversion model, the target identifier, the source conversion model, and the source identifier is configured using a neural network.

18. The computer-readable non-transitory recording medium of claim 15, the computer-executable instructions when executed further causing the system to:

receive waveform voice data as another source voice;

generate another target voice based on the updated target conversion model based on training; and provide the another target voice as a synthesized voice data.

19. The computer-readable non-transitory recording medium of claim 15, wherein the source conversion model and the target conversion model are based on one model based on a conditional generative adversarial network (GAN).

20. The computer-readable non-transitory recording medium of claim 15, wherein the original source voice and the first converted target voice are non-parallel data.

* * * * *